US012690607B2

(12) United States Patent
Farine et al.

(10) Patent No.: US 12,690,607 B2
(45) Date of Patent: Jul. 28, 2026

(54) CONCENTRATION OF WET TOBACCO EXTRACTS

(71) Applicant: Philip Morris Products S.A., Neuchatel (CH)

(72) Inventors: Marie Farine, Neuchatel (CH); Felix Frauendorfer, Neuchatel (CH); Sebastien Lanaspeze, Neuchatel (CH); Stefan Lauenstein, Neuchatel (CH); Christel Raphoz, Neuchatel (CH); Patrick Charles Silvestrini, Neuchatel (CH); Steve Tzimoulis, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 749 days.

(21) Appl. No.: 17/615,972

(22) PCT Filed: Jun. 5, 2020

(86) PCT No.: PCT/EP2020/065705
§ 371 (c)(1),
(2) Date: Dec. 2, 2021

(87) PCT Pub. No.: WO2020/245411
PCT Pub. Date: Dec. 10, 2020

(65) Prior Publication Data

US 2022/0256908 A1 Aug. 18, 2022

(30) Foreign Application Priority Data

Jun. 5, 2019 (EP) ..... 19178553

(51) Int. Cl.
*A24B 15/167* (2020.01)
*A24B 15/24* (2006.01)
*A24F 40/10* (2020.01)
*A24F 40/42* (2020.01)

(52) U.S. Cl.
CPC ..... *A24B 15/167* (2016.11); *A24B 15/24* (2013.01); *A24B 15/241* (2013.01); *A24B 15/243* (2013.01); *A24F 40/10* (2020.01); *A24F 40/42* (2020.01)

(58) Field of Classification Search
None
See application file for complete search history.

(56) References Cited

U.S. PATENT DOCUMENTS

| | | | | |
|---|---|---|---|---|
| 4,150,677 | A | 4/1979 | Osborne, Jr. et al. | |
| 5,016,654 | A | 5/1991 | Bernasek et al. | |
| 5,038,802 | A | 8/1991 | White et al. | |
| 5,235,992 | A | 8/1993 | Sensabaugh, Jr. | |
| 5,445,169 | A * | 8/1995 | Brinkley | A24B 15/24 131/297 |
| 2007/0023058 | A1 | 2/2007 | Howell et al. | |
| 2012/0192880 | A1 | 8/2012 | Dube et al. | |
| 2013/0160777 | A1 | 6/2013 | Murphy | |
| 2015/0320107 | A1 | 11/2015 | Dube et al. | |
| 2016/0360780 | A1 * | 12/2016 | Fujisawa | A24B 15/243 |
| 2017/0245543 | A1 | 8/2017 | Karles et al. | |

FOREIGN PATENT DOCUMENTS

| | | | | |
|---|---|---|---|---|
| CA | 2 940 680 | A1 | 9/2015 | |
| CN | 1415717 | A | 5/2003 | |
| CN | 102355914 | A | 2/2012 | |
| CN | 102905565 | A | 1/2013 | |
| CN | 103468406 | A | 12/2013 | |
| CN | 104287084 | A | 1/2015 | |
| CN | 104783323 | A | 7/2015 | |
| CN | 104921287 | A | 9/2015 | |
| CN | 104983064 | A | 10/2015 | |
| CN | 105167170 | A | 12/2015 | |
| CN | 105491899 | A | 4/2016 | |
| CN | 106028844 | A | 10/2016 | |
| CN | 107319637 | A | 11/2017 | |
| CN | 107485049 | A * | 12/2017 | A24B 15/28 |
| EP | 0 821 886 | A2 | 2/1998 | |
| EP | 3 111 784 | A1 | 1/2017 | |

(Continued)

OTHER PUBLICATIONS

CN-107485049-A, English machine translation (Year: 2017).*
Korean Office Action issued Aug. 28, 2023 in Korean Patent Application No. 10-2021-7036073 (with English Translation), 11 pages.
International Search Report and Written Opinion issued on Aug. 28, 2020 in PCT/EP2020/065705 filed Jun. 5, 2020, 11 pages.
Combined Chinese Office Action and Search Report issued Oct. 8, 2022 in Patent Application No. 202080033237.3 (with English language translation), 18 pages.
Japanese Notice of Reasons for Refusal issued Jun. 15, 2023 in Japanese Patent Application No. 2021-567988, (with English translation), 13 pages.
Combined Russian Office Action and Search Report issued Sep. 20, 2023 in Russian Patent Application No. 2021135522/03 (with English Translation), 15 pages.

(Continued)

*Primary Examiner* — Michael H. Wilson
*Assistant Examiner* — Michael T Fulton
(74) *Attorney, Agent, or Firm* — Oblon, McClelland, Maier & Neustadt, L.L.P.

(57) ABSTRACT

A method of manufacturing a concentrated tobacco extract for an aerosol-generating article is provided, including: providing a natural tobacco material; heating the material to a temperature and for a time such that volatile species including nicotine are released from the material, the heating includes heating the material in a flow of inert gas or in a flow of a combination of an inert gas with water or steam or heating the material under vacuum; collecting the released volatile species and forming a liquid, naturally derived tobacco extract including the collected species, a polyhydric alcohol, and at least about 40 percent by weight of water; and heating the liquid extract to evaporate at least some of the water and obtain concentrated tobacco extract, by heating to a temperature and for a time such that a water content in the naturally derived tobacco extract is reduced by at least about 60 percent.

20 Claims, No Drawings

(56) References Cited

FOREIGN PATENT DOCUMENTS

| | | | |
|---|---|---|---|
| GB | 2 031 707 | A | 4/1980 |
| JP | 2013-521007 | A | 6/2013 |
| KR | 10-2016-0110997 | | 9/2016 |
| RU | 2 639 111 | C1 | 12/2017 |
| WO | WO 2014/175399 | A1 | 10/2014 |
| WO | WO 2015/129679 | A1 | 9/2015 |
| WO | WO 2017/144705 | A1 | 8/2017 |
| WO | WO 2018/210676 | A1 | 11/2018 |

OTHER PUBLICATIONS

Extended European Search Report issued Nov. 27, 2019 in corresponding European Patent Application No. 19178553.4; 8 pages.

* cited by examiner

CONCENTRATION OF WET TOBACCO EXTRACTS

The present invention relates to a method of manufacturing a concentrated tobacco extract. Tobacco extracts obtained by a method in accordance with the present invention find use in aerosol-generating articles and devices. By way of example, tobacco extracts obtained by a method in accordance with the present invention find use in the preparation of a vaporisable composition for use in an aerosol-generating device, such as an electronic vaping device.

Aerosol-generating articles in which an aerosol-generating substrate, such as a nicotine-containing substrate or a tobacco-containing substrate, is heated rather than combusted, are known in the art. Typically, in such heated smoking articles (often referred to as "heat-not-burn" articles) an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article.

A number of different substrates for heated aerosol-generating articles have been disclosed. Among others, liquid nicotine compositions, often referred to as e-liquids, have been proposed as an alternative to solid substrates. These liquid compositions may, for example, be heated by a coiled electrically resistive filament of an aerosol-generating device.

Several methods are known for manufacturing a liquid tobacco extract. By way of example, WO 2017/144705 discloses a method wherein a tobacco material is heated to a temperature between 50 and 250 degrees Celsius, and volatile species released from the heated tobacco material are collected to manufacture a liquid formulation (also referred to as an e-liquid) for use in an e-vaping device.

Maceration methods are also known, wherein a tobacco material is kept in suspension in an extraction liquid for a period of up to several weeks or even months. The resulting slurry is subsequently filtered, and the liquid phase thus collected can be used to manufacture a vaporisable liquid formulation. In one such method—so-called "cold maceration method"—there is generally no way of controlling the extraction conditions (e.g. temperature and pressure). In a variant of a maceration method, which has been described for example in US 2012/192880, the slurry is heated to 100 degrees Celsius or more.

The liquid phase collected upon filtration of the slurry, which represents the primary product of a maceration process, is highly diluted, and tends to have a low content of apolar tobacco flavour species. Additionally, the liquid phase typically contains little to no nicotine. As such, liquid extracts obtained by a maceration method generally need to be supplemented with additional ingredients, such as nicotine salts and glycerin, before being used in a vaporisable liquid formulation.

Alternative processes are known, wherein a tobacco material is substantially boiled in water for a period of hours or even days to form a vapour phase, and a distillate obtained by condensation of the vapour phase is continuously collected in a vessel. Over time, an oily, waxy layer containing a high proportion of apolar compounds builds up on the surface of the distillate.

On the one hand, the aqueous portion, above which the waxy layer builds up, and which contains nicotine and other water-soluble compounds, is recycled to the boiler. An apolar co-solvent may optionally be fed into the boiler with the aqueous portion in order to increase the extraction yield. On the other hand, the waxy phase is collected and ultimately forms the primary product of one such hydro-distillation process. Such product is often referred to as "tobacco essential oil", and contains a high proportion of apolar compounds found in tobacco, such as fatty acids, neophytadiene, etc. The tobacco essential oil obtained by one such method typically contains no nicotine. It is also known to subject tobacco material to an extraction process involving use of a volatile apolar solvent. Examples of suitable solvents are cyclic or acyclic short alkanes, as well as chlorinated solvents like dichloromethane. In one such process, the excess solvent may be evaporated by controlled heating under vacuum. Typically, this is done in the presence of ethanol, which has a higher boiling point than the extraction solvent, such that even traces of the extraction solvent can be detected.

The primary product of one such solvent-aided extraction process is often referred to as "tobacco absolute", and may contain traces of ethanol. It is a waxy product and contains a highly concentrated mixture of most of the apolar compounds that can be extracted with the specific solvent, generally including nicotine, which is generally present at relatively high concentrations.

An alternative extraction process involves contacting a tobacco material with a solvent under supercritical conditions, such as supercritical carbon dioxide. One such process is disclosed in US 2013/160777, and relies on the principle that volatile substances within a feed material contacted with a supercritical fluid may partition into the supercritical phase. After dissolution of any soluble material, the supercritical fluid containing the dissolved substances can be removed, and the dissolved components of the feed matter can be separated out from the supercritical fluid. The primary product of a supercritical extraction process is substantially similar to the "tobacco absolute" of a solvent-aided extraction process run at lower temperature and pressure, contains no residual solvent and typically has a high level of the waxy, apolar compounds and includes nicotine, which is generally present at relatively high concentrations.

However, all the tobacco extracts obtainable by methods known in the art tend to have a very low level—if any—of compounds associated with the flavour of heated tobacco, such as furaneol.

It would be desirable to improve the existing naturally derived tobacco extracts by way of a finer adjustment of their content. By way of example, it would be desirable to be able to control the concentration of nicotine and flavour-bearing species vis-à-vis the concentration of less desirable compounds, such as phenol and tobacco-specific nitrosamines (TSNAs). This would be advantageous in that it may allow an aerosol to be delivered upon vaporisation of a liquid, nicotine-containing composition including the tobacco extract that can create a tailored sensory experience.

It may also be desirable to be able to reduce the water content of a naturally derived tobacco extract. This is so extracts obtained from different types of tobacco materials may be blended to obtain a variety of compositions. This may be particularly desirable as it may enable a further or alternative adjustment of the flavour characteristics of a liquid, nicotine-containing composition, as well as the flavour characteristics of an aerosol generated upon heating such composition.

A number of technologies are available for reducing the solvent content, and particularly the water content, of a liquid formulation, including the use of molecular sieves, freeze-drying, distillation, membrane permeation, liquid chromatography, and so forth. However, several of these technologies may have the drawback of potential toxicity issues. Further, the implementation of some of these technologies may be time-consuming or particularly costly, for example in terms of energy consumption. Thus, they may generally not be easy to incorporate into existing production lines or present environmental issues. In addition, some of these technologies may undesirably impact the flavour of the tobacco extract or of the nicotine composition prepared with the tobacco extract.

In addition, the content of certain non-flavour-related undesirable compounds has been found to be particularly difficult to control by means of an extraction process alone. For example, it has been observed that carbonyl compounds, such as acetaldehyde and formaldehyde, are typically present in a naturally derived tobacco extract, and it would be desirable to reduce their concentration.

Therefore, it would be desirable to provide a novel and improved method of manufacturing a concentrated tobacco extract. More particularly, it would be desirable to provide a novel and improved method of manufacturing a concentrated tobacco extract for use in the manufacture of a nicotine composition for use in an aerosol-generating device. It would also be desirable to provide a novel and improved method of manufacturing a concentrated tobacco extract that enables the reduction of the content of certain undesirable compounds, such as carbonyl compounds like acetaldehyde and formaldehyde.

Further, it would be desirable to provide a novel and improved, naturally derived tobacco extract suitable for use in the manufacture of a nicotine composition, such as for example an e-liquid to be vaporised in an aerosol-generating device.

The present disclosure relates to a method of manufacturing a concentrated tobacco extract for use in an aerosol-generating article. The method may comprise a step of providing a natural tobacco material. Further, the method may comprise a step of heating the natural tobacco material to a temperature and for a time such that volatile species are released from the natural tobacco material, the volatile species comprising nicotine. Such step of heating the natural tobacco material may comprise heating the natural tobacco material in a flow of inert gas or in a flow of a combination of an inert gas with water or steam. As an alternative, the step of heating the natural tobacco material may comprise heating the natural tobacco material under vacuum. The method may comprise a step of collecting the released volatile species and forming a liquid, naturally derived tobacco extract comprising the collected volatile species, a polyhydric alcohol, and at least about 40 percent by weight of water. In addition, the method may comprise a step of heating the liquid, naturally derived tobacco extract to evaporate at least some of the water and obtain concentrated tobacco extract. In such heating step the liquid, naturally derived tobacco extract may be heated to a temperature and for a time such that the water content in the tobacco extract is reduced by at least about 60 percent.

Further, the present disclosure relates to a concentrated, naturally derived tobacco extract of the type obtainable by a method as briefly set out above. The concentrated, naturally derived tobacco extract may comprise at least 0.2 percent by weight of nicotine, at least 75 percent by weight of a polyhydric alcohol, less than about 20 percent by weight of water and less than about 70 micrograms/gram acetaldehyde.

According to the present invention, there is provided a method of manufacturing a concentrated tobacco extract for use in an aerosol-generating article, the method comprising: providing a natural tobacco material; heating the natural tobacco material to a temperature and for a time such that volatile species are released from the natural tobacco material, the volatile species comprising nicotine, wherein heating the natural tobacco material preferably comprises heating the natural tobacco material in a flow of inert gas or in a flow of a combination of an inert gas with water or steam or heating the natural tobacco material under vacuum; collecting the released volatile species and forming a liquid, naturally derived tobacco extract comprising the collected volatile species, a polyhydric alcohol, and at least about 40 percent by weight of water; heating the liquid, naturally derived tobacco extract to evaporate at least some of the water and obtain concentrated tobacco extract, wherein the naturally derived tobacco extract is heated to a temperature and for a time such that the water content in the tobacco extract is reduced by at least about 60 percent.

According to the present invention, there is further provided a concentrated, naturally derived tobacco extract comprising at least 0.2 percent by weight of nicotine, at least about 75 percent by weight of a polyhydric alcohol, less than about 20 percent by weight of water and less than about 70 micrograms/gram acetaldehyde.

According to the present invention, there is also provided a concentrated, naturally derived tobacco extract comprising at least 0.2 percent by weight of nicotine, at least about 75 percent by weight of a polyhydric alcohol, less than about 20 percent by weight of water and less than about 12 micrograms/gram formaldehyde.

According to the present invention, there is further provided an aerosol-generating system comprising a cartomizer comprising a reservoir holding a vaporisable nicotine composition, a mouthpiece and a heater configured to heat the nicotine composition. The nicotine composition comprises a concentrated, naturally derived tobacco extract comprising at least 0.2 percent by weight of nicotine, at least about 75 percent by weight of a polyhydric alcohol, less than about 20 percent by weight of water and less than about 70 micrograms/gram acetaldehyde.

It will be appreciated that any features described with reference to one aspect of the present invention are equally applicable to any other aspect of the invention.

As used herein with reference to the present invention, the term "tobacco extract" is used to describe the direct product of an extraction process carried out on a tobacco starting material. Thus, the tobacco extract typically includes a mixture of natural components separated from, removed from, or derived from, a natural tobacco material using tobacco extraction processing conditions and techniques. Thus, in one such process extracted tobacco components are removed from the natural tobacco material and separated from unextracted tobacco components. It is known to obtain a tobacco extract by using a solvent, such as water or an organic solvent (for example alcohols). Further, it is known to obtain a tobacco extract by using heat to release volatile species from the tobacco material and to collect the volatile species by using a solvent. Thus, the tobacco extract typically also includes the liquid carrier or solvent that has been used to carry out the extraction process. Preferred tobacco extracts incorporate multiple extracted components that are obtained by using extraction processes and conditions that are not highly selective to a single component. Thus, in general, the term "tobacco extract" within the meaning of the present invention is used to refer to a mixture of components associated with the tobacco aroma and flavour. As such, an aerosol generated by vaporising a liquid formulation comprising those tobacco extracts may have desirable sensory characteristics.

The term "naturally derived tobacco extract" is used herein with reference to the present invention to describe a tobacco extract obtained from a natural tobacco material. As such, a "naturally derived extract" will contain some "endogenous nicotine", that is, nicotine that is naturally present in the tobacco plant and that has been separated from, removed from, or derived from tobacco plant material using tobacco extraction processing conditions and techniques. By contrast, a "naturally derived extract" does not contain synthetically derived nicotine.

The term "natural tobacco material" is used herein with reference to the present invention to describe any part of any plant member of the genus *Nicotiana*, including, but not limited to, leaves, midribs, stems and stalks. In particular, the natural tobacco material may comprise flue-cured tobacco material, Burley tobacco material, Oriental tobacco material, Maryland tobacco material, dark tobacco material, dark-fired tobacco material, *Rustica* tobacco material, as well as material from other rare or specialty tobaccos, or blends thereof. As will be described in more detail below, the tobacco material may be whole (for example, whole tobacco leaves), shredded, cut, ground, aged.

The term "concentrated tobacco extract" is used herein with reference to the present invention to describe a liquid tobacco extract obtained by an extraction process as described briefly above that has undergone a process by which the water content of the liquid tobacco extract has been reduced.

The term "aerosol generating article" is used herein to denote an article wherein an aerosol generating substrate is heated to produce and deliver an aerosol to a consumer. As used herein, the term "aerosol generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol generating articles, an aerosol is generated by heating a flavour generating substrate, such as a tobacco-based substrate or a substrate containing an aerosol-former and a flavouring.

Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention may find particular application in aerosol generating systems comprising an electrically heated aerosol generating device which is adapted to supply heat to a liquid formulation.

As used herein, the term "aerosol generating device" refers to a device comprising a heater element that interacts with a liquid formulation incorporating a concentrated tobacco extract obtained by a method in accordance with the invention to produce an aerosol. During use, volatile compounds are released from the liquid formulation by heat transfer and entrained in air drawn through the aerosol generating device. As the released compounds cool they condense to form an aerosol that is inhaled by the consumer.

Substrates for heated aerosol-generating articles typically comprise an "aerosol former", that is, a compound or mixture of compounds that, in use, facilitates formation of the aerosol, and that preferably is substantially resistant to thermal degradation at the operating temperature of the aerosol-generating article. Examples of suitable aerosol-formers include: polyhydric alcohols, such as propylene glycol, triethylene glycol, 1,3-propanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

The polyhydric alcohol in the aerosol-generating film of the invention is also an aerosol former within the meaning set out above.

Unless stated otherwise, percentages "by weight" of components of the tobacco extract recited herein are based on the total weight of the tobacco extract.

In a method in accordance with the present invention, a natural tobacco material is heated to a temperature and for a time such that volatile species are released from the natural tobacco material, the volatile species comprising nicotine. The volatile species are collected, such as by condensation or by trapping them by absorption with a solvent that is also an aerosol-former (for example, propylene glycol, 1,3-propanediol, vegetable glycerin or a mixture thereof). Thus, a liquid, naturally derived tobacco extract is formed that contains the collected species, a polyhydric alcohol, and at least about 40 percent by weight of water.

In contrast to existing methods, according to the present invention the naturally derived tobacco extract is heated to evaporate at least some of the water and obtain concentrated tobacco extract. In more detail, the naturally derived tobacco extract is heated to a temperature and for a time such that the water content in the tobacco extract is reduced by at least about 60 percent.

In preferred embodiments, as will be described in greater detail below, the naturally derived tobacco extract is heated under vacuum, preferably at a temperature of at least about 70 degrees Celsius. In other embodiments, the naturally derived tobacco extract is heated under a flow of air, preferably under a flow of air having relatively low humidity, at a temperature of at least about 35 degrees Celsius. Thus, a naturally derived, concentrated tobacco extract can be obtained by a method in accordance with the invention. One such naturally derived, concentrated tobacco extract contains (endogenous) nicotine and less than about 20 percent by weight of water.

Methods in accordance with the present invention advantageously provide a naturally derived, concentrated tobacco extract having a sufficiently high content of endogenous nicotine such that the concentrated tobacco extract may be vaporised in an aerosol-generating device without requiring the addition of exogenous nicotine. As such, a concentrated tobacco extract obtained by a method in accordance with the invention may conveniently be used as a component of a vaporisable nicotine composition, such as a nicotine-containing liquid formulation that can be heated to provide a user with an inhalable nicotine-containing aerosol.

Because the water content of the concentrated tobacco extract is low, concentrated tobacco extracts derived from different types of tobaccos may advantageously be combined to form blends having desirable contents of certain flavour compounds. In particular, the inventors have found that, in contrast to the existing extraction processes that have been discussed above, methods in accordance with the present invention advantageously provide a concentrated tobacco extract that has a significantly higher content of compounds associated with the flavour of heated tobacco, such as for example furaneol. These compounds are substantially absent, or are present in trace amounts, in a tobacco extract obtained by a maceration process, which also typically contains little to no nicotine. These compounds are also generally absent or present in trace amounts in a tobacco extract obtained using a solvent, including under supercritical conditions. Similarly, a tobacco essential oil obtained by way of a distillation process also typically has a very low content—if any—of such compounds associated with the flavour of heated tobacco.

Further, it has been found that by adjusting one or more of operating parameters such as heating temperature, duration of the heating operation, relative humidity of the flow of air (where required by the heating process), and pressure, not only is water evaporated, but also the content of certain carbonyl compounds, like formaldehyde and acetaldehyde, in the extract may be significantly reduced. Thus, concentrated tobacco extracts obtained by a method in accordance with the invention present significant compositional differences with respect to tobacco extracts obtained by the existing extraction processes, and can be used as an e-liquid or for the preparation of an e-liquid that, when heated, generates an aerosol having a distinct composition and flavour characteristics compared with currently available e-liquids. In particular, concentrated tobacco extracts obtained by a method in accordance with the invention may be used to generate an aerosol that provides a heated tobacco taste which more closely resembles an aerosol generated by conventional cigarettes or upon heating tobacco in a heat-not-burn device relative to available aerosols produced from existing liquid nicotine compositions.

Methods in accordance with the present invention can easily be implemented and incorporated into existing production lines for the manufacture of liquid formulations for use in aerosol-generating devices.

As described briefly below, a method according to the present invention comprises a first step of providing a natural tobacco material. In some embodiments, the natural tobacco material comprises one or more of Burley tobacco, Oriental tobacco, flue-cured tobacco.

In a second step, the natural tobacco material is heated to a temperature and for a time such that volatile species—including nicotine—are released from the natural tobacco material. In general, upon heating the natural tobacco material, any moisture present in the natural tobacco material is also released with the volatile species in the form of steam.

Preferably, in the second step, the natural tobacco material is heated in a flow of inert gas or in a flow of a combination of an inert gas with water or steam.

The inventors have found that it is advantageous to carry out the second, heating step in an inert atmosphere. This can be achieved by passing a flow of inert gas, such as nitrogen, through the natural tobacco material during the heating step, such that the inert gas acts as a carrier for the volatile component.

The flow of inert gas helps convey the steam generated by evaporation of the moisture content of the natural tobacco material and the volatile species—including, in particular, nicotine or flavour-associated compounds or both—out of the extraction equipment.

Further, use of a flow of inert gas, such as nitrogen, under light over-pressure in the extraction equipment has the benefit of preventing the presence of oxygen within the extraction equipment. This is also achievable by heating the natural tobacco material under vacuum. Such benefit is desirable in that it prevents risk of any, even partial, combustion of the natural tobacco material during the heating step. Uncontrolled combustion of the natural tobacco material would clearly be undesirable as it would represent a major safety risk within the manufacturing environment. However, the inventors have found that even a limited, partial combustion of the natural tobacco material may lead to a decrease in the quality of the tobacco extract obtainable by the method, which would be undesirable.

Without wishing to be bound by theory, it is understood that, by preventing combustion of the natural tobacco material, the formation of any undesirable combustion by-products is also prevented. Further, as conditions that would be conducive to combustion of the natural tobacco material are prevented, the natural tobacco material is effectively heated under conditions that mimic, to an extent, conditions under which a tobacco-containing substrate (e.g. homogenised tobacco material) is typically heated in "heat-not-burn" articles. As a result, selective extraction of the flavour-bearing volatile species responsible for the taste consumers associate with heated tobacco is advantageously favoured.

Therefore, by carrying out the second, heating step in an inert atmosphere the extraction efficiency, product quality and manufacturing safety are advantageously enhanced.

The inert gas flow rate may be optimised based on the scale and geometry of the extraction chamber. A relatively high flow rate of inert gas may advantageously further improve the efficiency of extraction from the tobacco starting material.

The addition of water or steam to the tobacco during extraction has been found to increase yield of extracted components. However, excess addition of water or steam leads to processing difficulties such as stickiness of the tobacco material.

In a third step, the volatile species are collected and a liquid, naturally derived tobacco extract is formed, the extract comprising the collected volatile species, a polyhydric alcohol, and at least 40 percent by weight of water.

In view of the third, collecting step, heating the natural tobacco material in the second step in a flow of inert gas or a flow comprising an inert gas and water or stream has the additional benefit that the inert gas flow containing the volatile compounds may be more easily directed into a container containing an extraction solvent, such as a non-aqueous extraction liquid solvent.

In a fourth step, the liquid, naturally derived tobacco extract is heated to evaporate at least some of the water and obtain concentrated tobacco extract. In more detail, the liquid, naturally derived tobacco extract is heated to a temperature and for a time such that the water content in the tobacco extract is reduced by at least about 60 percent.

In practice, the second step and the third step together define an extraction phase of the method. By means of this extraction phase, a liquid, non-concentrated tobacco extract is obtained from natural tobacco material. The fourth step defines a concentration phase of the method. By means of this concentration phase, a partially desiccated, concentrated tobacco extract is obtained from the liquid, non-concentrated tobacco extract obtained from the extraction phase.

The partially desiccated, concentrated tobacco extract can be considered the primary product of a method in accordance with the present invention. Depleted tobacco material, from which the volatile species and most of the moisture content have been extracted upon heating during the second step, may be considered a by-product of the method. Such depleted tobacco material may typically have a moisture content of about 1 to 5 percent by weight, preferably about 2 to 3 percent by weight. In preferred embodiments, in the second step the natural tobacco material is heated at an extraction temperature of between about 100 degrees Celsius and about 160 degrees Celsius. The heating may be carried out for at least 90 minutes.

One such extraction step uses an extraction temperature within a specific range in combination with a specifically defined heating duration that advantageously provides an improved liquid, naturally derived tobacco extract having a significantly improved balance of desirable compounds to undesirable compounds. In particular, under such conditions the second step of the present invention may provide a liquid, naturally derived tobacco extract having a maximised ratio of desirable compounds to undesirable compounds for the tobacco starting material. For example, the use of the specific combination of extraction temperature and time as defined enables the levels of nicotine compounds to be optimised whilst also minimising the levels of undesirable compounds such as furans, carbonyls, phenols and TSNAs.

It has been found that below the range described above, insufficient levels of nicotine and certain flavour compounds are released from the natural tobacco material such that the resultant liquid tobacco extract lacks the desired flavour characteristics. On the other hand, if the natural tobacco material is heated to a temperature above this defined range, unacceptably high levels of certain undesirable tobacco compounds may be released. Preferably, the extraction temperature is at least about 110 degrees Celsius, more preferably at least about 115 degrees Celsius, more preferably at least about 120 degrees Celsius, more preferably at least about 125 degrees Celsius. Preferably, the extraction temperature is no more than about 150 degrees Celsius, more preferably no more than about 145 degrees Celsius, more preferably no more than about 140 degrees Celsius, most preferably no more than about 135 degrees Celsius.

The natural tobacco material is heated at the extraction temperature for at least about 90 minutes, more preferably at least about 120 minutes. This extraction time is sufficiently long that the desired tobacco flavour compounds can be extracted efficiently to provide a liquid tobacco extract that can produce an aerosol having the desired flavour characteristics.

Preferably, the natural tobacco material is heated at the extraction temperature for no more than about 270 minutes, more preferably no more than about 180 minutes. For example, the natural tobacco material may be heated for between about 90 minutes and about 270 minutes, or between about 120 minutes and about 180 minutes. The heating time indicated above corresponds to the duration of time over which the natural tobacco material is heated at the extraction temperature and does not include the time taken to increase the temperature of the natural tobacco material up to the extraction temperature.

The extraction temperature and the duration of heating in the second step of a method in accordance with the present invention may be selected within the ranges defined above depending upon factors such as the type of tobacco, the desired level of nicotine or the desired composition of the liquid tobacco extract. By controlling the exact combination of extraction temperature and time, the composition of the liquid, naturally derived tobacco extract can be adjusted, for example depending on the desired characteristics of the aerosol that can be generated upon heating the liquid tobacco extract. In particular, the proportion of specific tobacco flavour compounds within the liquid tobacco extract can be adjusted to a certain degree through the selection of the extraction parameters in order to maximise the ratio of desirable to undesirable tobacco compounds within the liquid tobacco extract.

By way of example, it has been found that the level of desirable tobacco flavour compounds, such as β-damascenone and β-ionone, released from a tobacco material will increase with increasing extraction temperature up to a certain peak extraction temperature, after which the level will begin to decrease. The peak extraction temperature for such flavour compounds is typically within the range of 100 degrees Celsius to 160 degrees Celsius. By contrast, many undesirable tobacco compounds have been found to increase slowly with increasing extraction temperature up to a threshold temperature, beyond which a rapid increase is observed. This applies, for example, to the level of phenolic compounds, TSNAs and pyrazines and in the case of Bright tobaccos, to the level of furans and formaldehyde. In many cases, the threshold temperature is within the range of 100 degrees Celsius to 160 degrees Celsius. Therefore, the level of desirable and undesirable compounds in the liquid, naturally derived tobacco extract can effectively be controlled by selecting a suitable extraction temperature for the second step of methods in accordance with the invention.

The starting, natural tobacco material may be a solid tobacco material, such as a powder, leaf scraps or shreds, or intact leaf. Alternatively, the tobacco starting material may be a liquid tobacco material such as a dough, gel, slurry, or suspension. The natural tobacco material may be derived from any suitable tobacco material, including but not limited to tobacco leaf, tobacco stem, reconstituted tobacco, cast tobacco, extruded tobacco or tobacco derived pellets.

Preferably, in the step of preparing the natural tobacco material, the tobacco is ground or cut in order to reduce the size of tobacco particles within the tobacco starting material. This may advantageously improve the homogeneity of heating of the tobacco starting material and the efficiency of the extraction.

In certain embodiments of the present invention, the step of preparing the natural tobacco material may comprise the step of impregnating the natural tobacco material with an aerosol former. When this impregnation of the natural tobacco material is carried out prior to the heating step, it may advantageously increase the amount of certain desirable tobacco compounds that are released from the tobacco material upon heating. For example, impregnation of the natural tobacco material with glycerin has been found to advantageously increase the amount of nicotine that is extracted from the tobacco material. In another example, impregnation of the natural tobacco material with a polar aerosol former such as a mixture of polyethylene glycol and vegetal glycerin, or triacetin, has been found to advantageously increase the amount of flavour compounds that are extracted from the tobacco material.

Optionally, the natural tobacco material may be digested enzymatically prior to the heating step. This has been found to provide a significant increase in the yield of certain flavour compounds from the tobacco material.

Preferably, in the step of preparing the natural tobacco material, the tobacco is not subjected to any treatment adapted to alter the pH of the tobacco. In particular, in the step of preparing the natural tobacco material, the tobacco is not subjected to any treatment adapted to significantly increase the pH of the tobacco. For example, the natural tobacco material is not contacted with an aqueous solution containing a salt of an alkali or alkali-earth metal. Advantageously it has been found that maintaining the tobacco material in a less modified state may provide a more authentic or more natural flavour profile which may be appreciated by a consumer. Further, the inventors have found that subjecting the natural tobacco material to a treatment adapted to increase the pH of the tobacco, such as an alkali treatment, prior to heating the tobacco material as part of the extraction process leads to lower levels of desirable heated tobacco flavour compounds in the liquid tobacco extract. By way of example, not subjecting the natural tobacco material to an alkali treatment has been found to cause be associated with a significant increase in the weight ratio of (β-ionone+β-damascenone) to (phenol) in the liquid tobacco extract compared with an equivalent, alkali-treated natural tobacco material.

In the third step of methods in accordance with the present invention, a liquid, naturally derived tobacco extract is formed that includes the volatile compounds released from the tobacco. In practice, the stream of volatile compounds and stream released from the natural tobacco material upon heating, optionally further containing inert gas supplied during the second, heating step is further processed in order to form such liquid, naturally derived tobacco extract.

In general, the nature of this step may depend on the collection method. The "collected volatile compounds" will typically comprise a solution of the tobacco derived volatile compounds in a liquid solvent or carrier. Alternatively, where the volatile compounds are collected by condensation, the step of forming the liquid tobacco extract may comprise adding the condensate to a liquid solvent, such as an aerosol former.

The liquid, naturally derived tobacco extract obtained at the end of the third step is typically a homogenous liquid, that can be considered as an intermediate or semi-finished product. Such intermediate may be stored for a limited period of hold-time (up to about 4 weeks) prior to undergoing the fourth (desiccation) step of a method in accordance with the invention. The composition of the liquid, naturally derived tobacco extract depends on a number of variables, including the nature of the natural tobacco material; the moisture content in the natural tobacco material; the amount of aerosol former used to prepare the natural tobacco material, if any.

Optionally, the step of forming the liquid tobacco extract comprises a filtering step. Optionally, the step of forming the liquid tobacco extract comprises a blending step in which extracts derived from different tobacco starting materials are combined.

Polyhydric alcohols suitable for use in the third step of collecting the volatile species and forming a liquid, naturally derived tobacco extract containing the collected volatile species include, but are not limited to, polyhydric alcohols that are also suitable aerosol formers. As used herein with reference to the present invention the term "aerosol former" is used to describe a compound or mixture of compounds that, in use, facilitates formation of an aerosol, and that preferably is substantially resistant to thermal degradation at the operating temperature of an aerosol-generating article or device. Thus, polyhydric alcohols suitable for use in the third step of collecting the volatile species in methods in accordance with the invention include, but are not limited to, propylene glycol (PG), triethylene glycol, 1,3-propanediol, and glycerin (such as vegetable glycerin, VG).

Preferably, the polyhydric alcohol for use in the third step of collecting the volatile species in methods in accordance with the invention is selected from the group consisting of glycerin, PG, and combinations thereof. In particularly preferred embodiments the polyhydric alcohol is PG.

In preferred embodiments, in the third step of a method in accordance with the present invention, the volatile compounds are collected by condensation, and the condensate obtained is added to a liquid aerosol former, preferably PG.

The addition of a liquid aerosol former, and particularly addition of PG, may advantageously prevent the condensed volatile compounds from splitting into two phases or forming an emulsion, as some tobacco constituents would tend to do. Without wishing to be bound by theory, the inventors have observed that the solubility of the tobacco constituents in the hydrolate (i.e. the aqueous fraction of the liquid, naturally derived tobacco extract) depends primarily on their polarity, on their concentration and on the pH of the hydrolate, which may vary depending on the tobacco type. As a result, an oily layer tends to form at the surface of the liquid, naturally derived tobacco extract, if the amount of aerosol former is not sufficient. Such oily material can aggregate at different locations on the trapping and desiccation equipment wherein the third and further steps of the method are carried out, respectively. The addition of a liquid aerosol former, such as PG, helps prevent the formation of such layer and favours homogenisation of the liquid, naturally derived tobacco extract. This, in turn, helps prevent any loss of desirable flavour-associated compounds during the fourth (desiccation) step, during which such compounds may undesirably deposit on the equipment surfaces.

In addition, the liquid aerosol former advantageously helps trap the flavour-associated compounds independent of their polarity and volatility. Further, during the fourth (desiccation) step, the liquid aerosol former helps prevent loss of the most volatile fraction, as well as favour the selective removal of excess water from the liquid, naturally derived tobacco extract to obtain the concentrated tobacco extract.

Use of PG as the aerosol former for the condensation and collection step has the further advantage that, by reducing the water activity of aqueous solutions, PG exerts an antimicrobial activity. By adjusting the content of PG in the liquid, naturally derived tobacco extract, it is therefore also possible to ensure that the extract substantially does not undergo any microbial activity.

Preferably, in the fourth step the naturally derived tobacco extract is heated to a temperature and for a time such that the water content in the tobacco extract is reduced by at least about 65 percent. More preferably, the naturally derived tobacco extract is heated to a temperature and for a time such that the water content in the tobacco extract is reduced by at least about 70 percent.

In the fourth step, the naturally derived tobacco extract is preferably heated to a temperature and for a time such that the water content in the tobacco extract is reduced by less than or equal to about 95 percent. More preferably, the naturally derived tobacco extract is heated to a temperature and for a time such that the water content in the tobacco extract is reduced by less than or equal to about 90 percent.

Even more preferably, the naturally derived tobacco extract is heated to a temperature and for a time such that the water content in the tobacco extract is reduced by less than or equal to about 85 percent.

In some embodiments, in the fourth step the naturally derived tobacco extract is heated to a temperature and for a time such that the water content in the tobacco extract is reduced by from about 60 percent to about 95 percent, more preferably from about 65 percent to about 95 percent, even more preferably from about 70 percent to about 95 percent. In other embodiments, in the fourth step the naturally derived tobacco extract is heated to a temperature and for a time such that the water content in the tobacco extract is reduced by from about 60 percent to about 90 percent, more preferably from about 60 percent to about 85 percent, even more preferably from about 60 percent to about 80 percent. In further embodiments, in the fourth step the naturally derived tobacco extract is heated to a temperature and for a time such that the water content in the tobacco extract is reduced by from about 70 percent to about 95 percent, more preferably from about 70 percent to about 90 percent, even more preferably from about 70 percent to about 80 percent.

Preferably, the liquid, naturally derived tobacco extract formed in the third step of collecting the released volatile species comprises at least about 25 percent by weight of a polyhydric alcohol. More preferably, the liquid, naturally derived tobacco extract formed in the third step of collecting the released volatile species comprises at least about 30 percent by weight of a polyhydric alcohol. Even more preferably, the liquid, naturally derived tobacco extract formed in the third step of collecting the released volatile species comprises at least about 35 percent by weight of a polyhydric alcohol.

The liquid, naturally derived tobacco extract formed in the third step of collecting the released volatile species preferably comprises less than or equal to about 65 percent by weight of a polyhydric alcohol. More preferably, the liquid, naturally derived tobacco extract formed in the third step of collecting the released volatile species comprises less than or equal to about 60 percent by weight of a polyhydric alcohol. Even more preferably, the liquid, naturally derived tobacco extract formed in the third step of collecting the released volatile species comprises less than or equal to about 55 percent by weight of a polyhydric alcohol.

In some embodiments, the liquid, naturally derived tobacco extract formed in the third step of collecting the released volatile species comprises from about 25 percent by weight to about 65 percent by weight of a polyhydric alcohol. More preferably, the liquid, naturally derived tobacco extract formed in the third step of collecting the released volatile species comprises from about 25 percent by weight to about 60 percent by weight of a polyhydric alcohol. Even more preferably, the liquid, naturally derived tobacco extract formed in the third step of collecting the released volatile species comprises from about 25 percent by weight to about 55 percent by weight of a polyhydric alcohol. In other embodiments, the liquid, naturally derived tobacco extract formed in the third step of collecting the released volatile species comprises from about 30 percent by weight to about 65 percent by weight of a polyhydric alcohol, more preferably from about 30 percent by weight to about 60 percent by weight of a polyhydric alcohol, even more preferably from about 30 percent by weight to about 55 percent by weight of a polyhydric alcohol. In further embodiments, the liquid, naturally derived tobacco extract formed in the third step of collecting the released volatile species comprises from about 35 percent by weight to about 65 percent by weight of a polyhydric alcohol, more preferably from about 35 percent by weight to about 60 percent by weight of a polyhydric alcohol, even more preferably from about 35 percent by weight to about 55 percent by weight of a polyhydric alcohol.

In some preferred embodiments, the fourth step of heating the liquid, naturally derived tobacco extract to evaporate at least some of the water and obtain concentrated tobacco extract is carried out under vacuum.

Preferably, in the fourth step of heating the liquid, naturally derived tobacco extract in methods in accordance with the invention the naturally derived tobacco extract is heated at a pressure of less than or equal to about 200 mbar. More preferably, in the fourth step of heating the liquid, naturally derived tobacco extract in methods in accordance with the invention the naturally derived tobacco extract is heated at a pressure of less than or equal to about 150 mbar. Even more preferably, in the fourth step of heating the liquid, naturally derived tobacco extract in methods in accordance with the invention the naturally derived tobacco extract is heated at a pressure of less than or equal to about 100 mbar. In particularly preferred embodiments, in the fourth step of heating the liquid, naturally derived tobacco extract in methods in accordance with the invention the naturally derived tobacco extract is heated at a pressure of less than or equal to about 90 mbar, more preferably less than or equal to about 80 mbar, even more preferably less than or equal to about 70 mbar.

In the fourth step of heating the liquid, naturally derived tobacco extract in methods in accordance with the invention the naturally derived tobacco extract is preferably heated at a pressure of at least about 20 mbar. More preferably, in the fourth step of heating the liquid, naturally derived tobacco extract in methods in accordance with the invention the naturally derived tobacco extract is heated at a pressure of at least about 30 mbar. Even more preferably, in the fourth step of heating the liquid, naturally derived tobacco extract in methods in accordance with the invention the naturally derived tobacco extract is heated at a pressure of at least about 40 mbar.

In some embodiments, in the fourth step of heating the liquid, naturally derived tobacco extract, the naturally derived tobacco extract is heated at a pressure from about 20 mbar to about 200 mbar, more preferably from about 20 mbar to about 150 mbar, even more preferably from about 20 mbar to about 100 mbar. In particularly preferred embodiments, in the fourth step of heating the liquid, naturally derived tobacco extract, the naturally derived tobacco extract is heated at a pressure from about 20 mbar to about 90 mbar, more preferably from about 20 mbar to about 80 mbar, even more preferably from about 20 mbar to about 70 mbar.

In other embodiments, in the fourth step of heating the liquid, naturally derived tobacco extract, the naturally derived tobacco extract is heated at a pressure from about 30 mbar to about 200 mbar, more preferably from about 30 mbar to about 150 mbar, even more preferably from about 30 mbar to about 100 mbar. In particularly preferred embodiments, in the fourth step of heating the liquid, naturally derived tobacco extract, the naturally derived tobacco extract is heated at a pressure from about 30 mbar to about 90 mbar, more preferably from about 30 mbar to about 80 mbar, even more preferably from about 30 mbar to about 70 mbar.

In further embodiments, in the fourth step of heating the liquid, naturally derived tobacco extract, the naturally derived tobacco extract is heated at a pressure from about 40 mbar to about 200 mbar, more preferably from about 40 mbar to about 150 mbar, even more preferably from about 40 mbar to about 100 mbar. In particularly preferred embodiments, in the fourth step of heating the liquid, naturally derived tobacco extract, the naturally derived tobacco extract is heated at a pressure from about 40 mbar to about 90 mbar, more preferably from about 40 mbar to about 80 mbar, even more preferably from about 40 mbar to about 70 mbar.

In most preferred embodiments, in the fourth step of heating the liquid, naturally derived tobacco extract, the naturally derived tobacco extract is heated at a pressure from about 40 mbar to about 60 mbar. By way of example, in the fourth step of heating the liquid, naturally derived tobacco extract, the naturally derived tobacco extract is heated at a pressure of about 50 mbar.

Carrying out the fourth step of heating the liquid, naturally derived tobacco extract under vacuum at a pressure within the ranges described above has been found to favour a relatively rapid removal of significant amounts of water, such that the overall concentration process is made particularly cost-effective and may have a reduced environmental impact, as less energy is consumed over a shorter period of time, compared with other known techniques for concentrating a liquid composition.

As an alternative to using vacuum, in other embodiments of the method in accordance with the invention the fourth step of heating the liquid, naturally derived tobacco extract to evaporate at least some of the water and obtain concentrated tobacco extract is carried out under a controlled, gaseous current. By way of example, the fourth step of heating the liquid, naturally derived tobacco extract may be carried out under a flow of air.

Preferably, in the fourth step of heating the liquid, naturally derived tobacco extract, the naturally derived tobacco extract is heated under a flow of air of at least about 5 kg/h. More preferably, in the fourth step of heating the liquid, naturally derived tobacco extract, the naturally derived tobacco extract is heated under a flow of air of at least about 10 kg/h. Even more preferably, in the fourth step of heating the liquid, naturally derived tobacco extract, the naturally derived tobacco extract is heated under a flow of air of at least about 15 kg/h.

Preferably, a relative humidity of the flow of air is less than or equal to 50 percent. More preferably, a relative humidity of the flow of air is less than or equal to 40 percent. Even more preferably, a relative humidity of the flow of air is less than or equal to 30 percent. In particularly preferred embodiments, a relative humidity of the flow of air is less than or equal to 25 percent, more preferably less than or equal to 20 percent, even more preferably less than or equal to 15 percent. Carrying out the fourth step of heating the liquid, naturally derived tobacco extract under a flow of air having a relative humidity within the ranges described above has been found to favour the removal of larger amounts of water in a shorter period of time, and so it is desirable from a viewpoint of cost-effectiveness and energy consumption of the overall process, and may enable a reduced environmental impact.

When carrying out the fourth step of heating the liquid, naturally derived tobacco extract, be it under vacuum or under a flow of air, the naturally derived tobacco extract is preferably heated to at least about 35 degrees Celsius. More preferably, in the fourth step of heating the liquid, naturally derived tobacco extract, be it under vacuum or under a flow of air, the naturally derived tobacco extract is heated to at least about 50 degrees Celsius. Even more preferably, in the fourth step of heating the liquid, naturally derived tobacco extract, be it under vacuum or under a flow of air, the naturally derived tobacco extract is heated to at least about 70 degrees Celsius.

When carrying out the fourth step of heating the liquid, naturally derived tobacco extract, be it under vacuum or under a flow of air, the naturally derived tobacco extract is preferably heated to less than or equal to about 95 degrees Celsius. More preferably, in the fourth step of heating the liquid, naturally derived tobacco extract, be it under vacuum or under a flow of air, the naturally derived tobacco extract is heated to less than or equal to about 90 degrees Celsius. Even more preferably, in the fourth step of heating the liquid, naturally derived tobacco extract, be it under vacuum or under a flow of air, the naturally derived tobacco extract is heated to less than or equal to about 85 degrees Celsius. Most preferably, in the fourth step of heating the liquid, naturally derived tobacco extract, be it under vacuum or under a flow of air, the naturally derived tobacco extract is heated to less than or equal to about 80 degrees Celsius.

In some embodiments, in the fourth step of heating the liquid, naturally derived tobacco extract, be it under vacuum or under a flow of air, the naturally derived tobacco extract is heated to from about 35 degrees Celsius to about 95 degrees Celsius, more preferably from about 35 degrees Celsius to about 90 degrees Celsius, even more preferably from about 35 degrees Celsius to about 85 degrees Celsius, most preferably from about 35 degrees Celsius to about 80 degrees Celsius. In other embodiments, in the fourth step of heating the liquid, naturally derived tobacco extract, be it under vacuum or under a flow of air, the naturally derived tobacco extract is heated to from about 50 degrees Celsius to about 95 degrees Celsius, more preferably from about 50 degrees Celsius to about 90 degrees Celsius, even more preferably from about 50 degrees Celsius to about 85 degrees Celsius, most preferably from about 50 degrees Celsius to about 80 degrees Celsius. In further embodiments, in the fourth step of heating the liquid, naturally derived tobacco extract, be it under vacuum or under a flow of air, the naturally derived tobacco extract is heated to from about 70 degrees Celsius to about 95 degrees Celsius, more preferably from about 70 degrees Celsius to about 90 degrees Celsius, even more preferably from about 70 degrees Celsius to about 85 degrees Celsius, most preferably from about 70 degrees Celsius to about 80 degrees Celsius.

Carrying out the fourth step of heating the liquid, naturally derived tobacco extract the liquid, by heating the liquid, naturally derived tobacco extract to a temperature within the ranges described above has been found to favour the removal of significant amounts of water in a short period of time, whilst at the same time advantageously preserving the quality of the extracted flavour-bearing compounds among the collected volatile species. This is advantageous in that it may enable the provision of a concentrated tobacco extract that can be used for the manufacture of a nicotine composition adapted to provide the consumer with a tailored sensory experience when the nicotine composition is heated to generate an inhalable aerosol. Further, as the temperature is maintained below 100 degrees Celsius, it is advantageously easier to control evaporation of water by adjusting the pressure or the flow of air whilst at the same time maintaining the overall energy consumption below a desirable threshold.

Preferably, in the fourth step of heating the liquid, naturally derived tobacco extract to evaporate at least some of the water, the liquid, naturally derived tobacco extract is heated to a temperature and for a time such that a concentrated tobacco extract is obtained that contains less than or equal to about 25 percent by weight of water. More preferably, the liquid, naturally derived tobacco extract is heated to a temperature and for a time such that a concentrated tobacco extract is obtained that contains less than or equal to about 20 percent by weight of water. Even more preferably, the liquid, naturally derived tobacco extract is heated to a temperature and for a time such that a concentrated tobacco extract is obtained that contains less than or equal to about 15 percent by weight of water.

In the fourth step of heating the liquid, naturally derived tobacco extract to evaporate at least some of the water, the liquid, naturally derived tobacco extract may be heated to a temperature and for a time such that a concentrated tobacco extract is obtained that contains at least about 1 percent by weight of water. Preferably, in the fourth step of heating the liquid, naturally derived tobacco extract to evaporate at least some of the water, the liquid, naturally derived tobacco extract may be heated to a temperature and for a time such that a concentrated tobacco extract is obtained that contains at least about 5 percent by weight of water. More preferably, the liquid, naturally derived tobacco extract may be heated to a temperature and for a time such that a concentrated tobacco extract is obtained that contains at least about 8 percent by weight of water. Even more preferably, the liquid, naturally derived tobacco extract may be heated to a temperature and for a time such that a concentrated tobacco extract is obtained that contains at least about 10 percent by weight of water.

In some embodiments, in the fourth step of heating the liquid, naturally derived tobacco extract to evaporate at least some of the water, the liquid, naturally derived tobacco extract may be heated to a temperature and for a time such that a concentrated tobacco extract is obtained that contains from about 1 percent by weight of water to about 25 percent by weight of water, more preferably from about 1 percent by weight of water to about 20 percent by weight of water, even more preferably from about 1 percent by weight of water to about 15 percent by weight of water. In other embodiments, in the fourth step of heating the liquid, naturally derived tobacco extract to evaporate at least some of the water, the liquid, naturally derived tobacco extract may be heated to a temperature and for a time such that a concentrated tobacco extract is obtained that contains from about 5 percent by weight of water to about 25 percent by weight of water, more preferably from about 5 percent by weight of water to about 20 percent by weight of water, even more preferably from about 5 percent by weight of water to about 15 percent by weight of water. In further embodiments, in the fourth step of heating the liquid, naturally derived tobacco extract to evaporate at least some of the water, the liquid, naturally derived tobacco extract may be heated to a temperature and for a time such that a concentrated tobacco extract is obtained that contains from about 8 percent by weight of water to about 25 percent by weight of water, more preferably from about 8 percent by weight of water to about 20 percent by weight of water, even more preferably from about 8 percent by weight of water to about 15 percent by weight of water.

In the fourth step of heating the liquid, naturally derived tobacco extract to evaporate at least some of the water, the liquid, naturally derived tobacco extract may be heated to a temperature and for a time such that a concentrated tobacco extract is obtained that contains at least about 65 percent by weight of polyhydric alcohol. Preferably, in the fourth step of heating the liquid, naturally derived tobacco extract to evaporate at least some of the water, the liquid, naturally derived tobacco extract is heated to a temperature and for a time such that a concentrated tobacco extract is obtained that contains at least about 70 percent by weight of polyhydric alcohol. More preferably, in the fourth step of heating the liquid, naturally derived tobacco extract to evaporate at least some of the water, the liquid, naturally derived tobacco extract is heated to a temperature and for a time such that a concentrated tobacco extract is obtained that contains at least about 75 percent by weight of polyhydric alcohol.

In the fourth step of heating the liquid, naturally derived tobacco extract to evaporate at least some of the water, the liquid, naturally derived tobacco extract may be heated to a temperature and for a time such that a concentrated tobacco extract is obtained that contains less than or equal to about 95 percent by weight of polyhydric alcohol. Preferably, in the fourth step of heating the liquid, naturally derived tobacco extract to evaporate at least some of the water, the liquid, naturally derived tobacco extract is heated to a temperature and for a time such that a concentrated tobacco extract is obtained that contains less than or equal to about 90 percent by weight of polyhydric alcohol. More preferably, the fourth step of heating the liquid, naturally derived tobacco extract to evaporate at least some of the water, the liquid, naturally derived tobacco extract is heated to a temperature and for a time such that a concentrated tobacco extract is obtained that contains less than or equal to about 85 percent by weight of polyhydric alcohol.

In some embodiments, in the fourth step of heating the liquid, naturally derived tobacco extract to evaporate at least some of the water, the liquid, naturally derived tobacco extract is preferably heated to a temperature and for a time such that a concentrated tobacco extract is obtained that contains from about 65 percent by weight to about 95 percent by weight of polyhydric alcohol, more preferably from about 65 percent by weight to about 90 percent by weight of polyhydric alcohol, even more preferably from about 65 percent by weight to about 85 percent by weight of polyhydric alcohol. In other embodiments, in the fourth step of heating the liquid, naturally derived tobacco extract to evaporate at least some of the water, the liquid, naturally derived tobacco extract is preferably heated to a temperature and for a time such that a concentrated tobacco extract is obtained that contains from about 70 percent by weight to about 95 percent by weight of polyhydric alcohol, more preferably from about 70 percent by weight to about 90 percent by weight of polyhydric alcohol, even more preferably from about 70 percent by weight to about 85 percent by weight of polyhydric alcohol. In further embodiments, in the fourth step of heating the liquid, naturally derived tobacco extract to evaporate at least some of the water, the liquid, naturally derived tobacco extract is preferably heated to a temperature and for a time such that a concentrated tobacco extract is obtained that contains from about 75 percent by weight to about 95 percent by weight of polyhydric alcohol, more preferably from about 75 percent by weight to about 90 percent by weight of polyhydric alcohol, even more preferably from about 75 percent by weight to about 85 percent by weight of polyhydric alcohol.

In accordance with the present invention, the second step and the third step are carried out under the conditions described above such that the liquid, naturally derived tobacco extract obtained from the extraction phase of the method contains nicotine.

As used herein with reference to the invention, the term "nicotine" is used to describe nicotine, a nicotine base or a nicotine salt. In embodiments in which the liquid, naturally derived tobacco extract comprises a nicotine salt, the amounts of nicotine recited herein are the amount of protonated nicotine. In particular, the liquid, naturally derived tobacco extract may comprise one or more polyprotic nicotine salts. As used herein with reference to the invention, the term "polyprotic nicotine salt" is used to describe a nicotine salt of a polyprotic acid.

Preferably, the liquid, naturally derived tobacco extract obtained from the extraction phase of the method contains at least about 0.1 percent by weight of nicotine. More preferably, the liquid, naturally derived tobacco extract obtained from the extraction phase of the method contains at least about 0.2 percent by weight of nicotine. Even more preferably, the liquid, naturally derived tobacco extract obtained from the extraction phase of the method contains at least about 0.5 percent by weight of nicotine. In particularly preferred embodiments, the liquid, naturally derived tobacco extract obtained from the extraction phase of the method contains at least about 1 percent by weight of nicotine.

The liquid, naturally derived tobacco extract obtained from the extraction phase of the method preferably comprises less than or equal to about 10 percent by weight nicotine. More preferably, the liquid, naturally derived tobacco extract obtained from the extraction phase of the method comprises less than or equal to about 8 percent by weight nicotine. Even more preferably, the liquid, naturally derived tobacco extract obtained from the extraction phase of the method comprises less than or equal to about 5 percent by weight nicotine.

In some embodiments, the liquid, naturally derived tobacco extract obtained from the extraction phase of the method contains from about 0.1 percent by weight to about 10 percent by weight nicotine. More preferably, the liquid, naturally derived tobacco extract obtained from the extraction phase of the method contains from about 0.1 percent by weight to about 8 percent by weight nicotine. Even more preferably, the liquid, naturally derived tobacco extract obtained from the extraction phase of the method contains from about 0.1 percent by weight to about 5 percent by weight nicotine. In preferred embodiments, the liquid, naturally derived tobacco extract obtained from the extraction phase of the method contains from about 0.2 percent by weight to about 10 percent by weight nicotine. More preferably, the liquid, naturally derived tobacco extract obtained from the extraction phase of the method contains from about 0.2 percent by weight to about 8 percent by weight nicotine. Even more preferably, the liquid, naturally derived tobacco extract obtained from the extraction phase of the method contains from about 0.2 percent by weight to about 5 percent by weight nicotine.

In other embodiments, the liquid, naturally derived tobacco extract obtained from the extraction phase of the method contains from about 0.5 percent by weight to about 10 percent by weight nicotine. More preferably, the liquid, naturally derived tobacco extract obtained from the extraction phase of the method contains from about 0.5 percent by weight to about 8 percent by weight nicotine. Even more preferably, the liquid, naturally derived tobacco extract obtained from the extraction phase of the method contains from about 0.5 percent by weight to about 5 percent by weight nicotine. In further embodiments, the liquid, naturally derived tobacco extract obtained from the extraction phase of the method contains from about 1 percent by weight to about 10 percent by weight nicotine. More preferably, the liquid, naturally derived tobacco extract obtained from the extraction phase of the method contains from about 1 percent by weight to about 8 percent by weight nicotine. Even more preferably, the liquid, naturally derived tobacco extract obtained from the extraction phase of the method contains from about 1 percent by weight to about 5 percent by weight nicotine.

In accordance with the present invention, the fourth step is carried out under the conditions described above such that the concentrated tobacco extract obtained from the concentration phase of the method has an increased nicotine content compared with the liquid, naturally derived tobacco extract. Preferably, the concentrated tobacco extract obtained from the concentration phase of the method contains at least about 0.2 percent by weight of nicotine. More preferably, the concentrated tobacco extract obtained from the concentration phase of the method contains at least about 0.5 percent by weight of nicotine. Even more preferably, the concentrated tobacco extract obtained from the concentration phase of the method contains at least about 1 percent by weight of nicotine. In particularly preferred embodiments, the concentrated tobacco extract obtained from the concentration phase of the method contains at least about 2 percent by weight of nicotine.

The concentrated tobacco extract obtained from the concentration phase of the method preferably comprises less than or equal to about 12 percent by weight nicotine. More preferably, the concentrated tobacco extract obtained from the concentration phase of the method comprises less than or equal to about 10 percent by weight nicotine. Even more preferably, the concentrated tobacco extract obtained from the concentration phase of the method comprises less than or equal to about 8 percent by weight nicotine.

In some embodiments, the concentrated tobacco extract obtained from the concentration phase of the method contains from about 0.2 percent by weight to about 12 percent by weight nicotine. More preferably, the concentrated tobacco extract obtained from the concentration phase of the method contains from about 0.2 percent by weight to about 10 percent by weight nicotine. Even more preferably, the concentrated tobacco extract obtained from the concentration phase of the method contains from about 0.2 percent by weight to about 8 percent by weight nicotine. In preferred embodiments, the concentrated tobacco extract obtained from the concentration phase of the method contains from about 0.5 percent by weight to about 12 percent by weight nicotine. More preferably, the concentrated tobacco extract obtained from the concentration phase of the method contains from about 0.5 percent by weight to about 10 percent by weight nicotine. Even more preferably, the concentrated tobacco extract obtained from the concentration phase of the method contains from about 0.5 percent by weight to about 8 percent by weight nicotine.

In other embodiments, the concentrated tobacco extract obtained from the concentration phase of the method contains from about 1 percent by weight to about 12 percent by weight nicotine. More preferably, the concentrated tobacco extract obtained from the concentration phase of the method contains from about 1 percent by weight to about 10 percent by weight nicotine. Even more preferably, the concentrated tobacco extract obtained from the concentration phase of the method contains from about 1 percent by weight to about 8 percent by weight nicotine. In further embodiments, the concentrated tobacco extract obtained from the concentration phase of the method contains from about 2 percent by weight to about 12 percent by weight nicotine. More preferably, the concentrated tobacco extract obtained from the concentration phase of the method contains from about 2 percent by weight to about 10 percent by weight nicotine. Even more preferably, the concentrated tobacco extract obtained from the concentration phase of the method contains from about 2 percent by weight to about 8 percent by weight nicotine.

It has been surprisingly found that by carrying out a method in accordance with the present invention under the conditions described above a concentrated tobacco extract is obtained that contains smaller amounts of certain carbonyl compounds, such as acetaldehyde and formaldehyde, compared with the tobacco extracts obtained by existing methods.

Preferably, the concentrated tobacco extract comprises less than about 70 micrograms/gram acetaldehyde. More preferably, the concentrated tobacco extract comprises less than about 60 micrograms/gram acetaldehyde. Even more preferably, the concentrated tobacco extract comprises less than about 50 micrograms/gram acetaldehyde.

In some embodiments, the concentrated tobacco extract preferably comprises from about 1 microgram/gram acetaldehyde to about 70 micrograms/gram acetaldehyde, more preferably from about 1 microgram/gram acetaldehyde to about 60 micrograms/gram acetaldehyde, even more preferably from about 1 microgram/gram acetaldehyde to about 50 micrograms/gram acetaldehyde.

Preferably, the concentrated tobacco extract comprises less than about 14 micrograms/gram formaldehyde. More preferably, the concentrated tobacco extract comprises less than about 12 micrograms/gram formaldehyde. Even more preferably, the concentrated tobacco extract comprises less than about 10 micrograms/gram formaldehyde.

In some embodiments, the concentrated tobacco extract preferably comprises from about 1 microgram/gram acetaldehyde to about 14 micrograms/gram formaldehyde, more preferably from about 1 microgram/gram acetaldehyde to about 12 micrograms/gram formaldehyde, even more preferably from about 1 microgram/gram acetaldehyde to about 10 micrograms/gram formaldehyde.

According to another aspect of the present invention there is provided a concentrated, naturally derived tobacco extract. In some embodiments, the concentrated, naturally derived tobacco extract comprises at least 0.2 percent by weight of nicotine, at least about 75 percent by weight of a polyhydric alcohol, less than about 20 percent by weight of water, and less than about 70 micrograms/gram acetaldehyde. In preferred embodiments, the concentrated, naturally derived tobacco extract comprises at least 0.5 percent by weight of nicotine, at least about 75 percent by weight of a polyhydric alcohol, less than about 20 percent by weight of water, and less than about 70 micrograms/gram acetaldehyde.

According to a further aspect of the present invention there is provided a concentrated, naturally derived tobacco extract. In some embodiments, the concentrated, naturally derived tobacco extract comprises at least 0.2 percent by weight of nicotine, at least about 75 percent by weight of a polyhydric alcohol, less than about 20 percent by weight of water, and less than about 14 micrograms/gram formaldehyde. In preferred embodiments, the concentrated, naturally derived tobacco extract comprises at least 0.5 percent by weight of nicotine, at least about 75 percent by weight of a polyhydric alcohol, less than about 20 percent by weight of water, and less than about 14 micrograms/gram formaldehyde.

A concentrated tobacco extract obtained by a method in accordance with the present invention may be used in the manufacture of a nicotine composition for use in an aerosol-generating system.

A nicotine composition comprising a concentrated tobacco extract obtained by a method according to the present invention may be provided in a cartridge for use in an aerosol-generating system. The cartridge may comprise an atomiser, configured to generate an aerosol from the nicotine composition. The atomiser may be a thermal atomiser, which is configured to heat the nicotine composition to generate an aerosol. The thermal atomiser may comprise, for example, a heater and a liquid transport element configured to transport the nicotine composition to the heater. The liquid transport element may comprise a capillary wick. Alternatively, the atomiser may be a non-thermal atomiser, which is configured to generate an aerosol from the nicotine composition by means other than heating. The non-thermal atomiser may be, for example, an impinging jet atomiser, an ultrasonic atomiser or a vibrating mesh atomiser.

The cartridge containing the nicotine composition formed from the concentrated tobacco extract obtained by a method in accordance with the present invention may be used in conjunction with any suitable aerosol-generating device comprising a housing configured to receive at least a portion of the cartridge. The aerosol-generating device may comprise a battery and control electronics.

By way of example, an aerosol-generating system may be provided that comprises a cartomizer containing a vaporisable nicotine composition. The cartomizer may comprise a reservoir for holding the vaporisable nicotine composition, a mouthpiece and a heater configured to heat the vaporisable nicotine composition. The nicotine composition may for example comprise at least 0.2 percent by weight of nicotine, at least about 75 percent by weight of a polyhydric alcohol, less than about 20 percent by weight of water and less than about 70 micrograms/gram acetaldehyde. More preferably, the nicotine composition may comprise at least about 0.5 percent by weight of nicotine, at least about 75 percent by weight of a polyhydric alcohol, less than about 20 percent by weight of water and less than about 70 micrograms/gram acetaldehyde.

An embodiment of the present invention will now be further described, by way of example only.

Example 1

A tobacco starting material is prepared from a flue-cured Bright tobacco material. The tobacco material is cut to form tobacco shreds having dimensions of 2.5 millimetres by 2.5 millimetres and the tobacco shreds are loaded into an extraction chamber, without compression. The tobacco starting material is heated within the extraction chamber to a temperature of 130 degrees Celsius for a period of 3 hours. During heating, a flow of nitrogen is passed through the extraction chamber at a flow rate of about 40 litres per minute.

The volatile compounds released from the tobacco starting material during the heating step are collected by absorption into a liquid solvent formed of polyethylene glycol at minus 10 degrees Celsius and with agitation of 750 rpm.

The solution of polyethylene glycol with the collected volatile compounds is concentrated to reduce the water content of the liquid tobacco extract to approximately 15 percent by weight. In more detail, the solution of polyethylene glycol with the collected volatile compounds is heated at 50 mbar to 75 degrees Celsius.

To this purpose, the solution of polyethylene glycol with the collected volatile compounds is circulated in a loop under vacuum. An evaporation tube defines a portion of the loop. The evaporation tube is arranged vertically and the solution of polyethylene glycol with the collected volatile compounds is made to flow from top to bottom by forming a thin film of the solution on the inner surface of the wall of the evaporation tube. The evaporation tube is heated externally to raise the temperature of the film. When the solution in the film reaches the boiling point, evaporation begins, and water is the main component of the solution leaving the film.

The evaporated water is condensed and removed from the loop. The solution of polyethylene glycol is circulated for as long as necessary to achieve the target water concentration. It will be clear to the skilled person that the time needed to achieve the target water concentration may typically depend on the size of the equipment and the amount of solution of polyethylene glycol to be processed. Further, the time needed to achieve the target water concentration may differ if the operation is run a continuous process or as a batch process.

The resultant concentrated liquid tobacco extract provides optimised levels of desirable flavour compounds such as β-damascenone and β-ionone whilst retaining relatively low levels of other undesirable tobacco compounds such as carbonyls, phenols, furans and TSNAs. In particular, the resultant concentrated liquid tobacco extract contains about 20 micrograms/g acetaldehyde and about 10 micrograms/g formaldehyde.

Example 2

Three tobacco starting materials in accordance with the present invention are prepared from a flue-cured Bright tobacco material (2A), a Burley tobacco material (2B), and an Oriental tobacco material (2C), respectively.

Each one of the three tobacco materials is cut to form tobacco shreds having dimensions of 2.5 millimetres by 2.5 millimetres, and the tobacco shreds are loaded into an extraction chamber, without compression.

Each one of the tobacco starting materials is heated within the extraction chamber to a temperature of 130 degrees Celsius for a period of 120 minutes. During heating, a flow of nitrogen is passed through the extraction chamber at a flow rate of 2 litres per minute.

The volatile compounds released from each tobacco starting material during the heating step are collected by absorption into a liquid solvent formed of polypropylene glycol at 0 degrees Celsius.

A liquid tobacco extract is obtained directly from such extraction process. Each liquid extract obtained from each one of the three tobacco starting materials is then concentrated under vacuum (50 mbar) at 55 degrees Celsius until a moisture content of 12 percent±2 percent is reached.

TABLE 1

Value of selected ratios by weight of desirable to undesirable tobacco compounds within the liquid tobacco extracts

| Example | (β-ionone + β-damascenone) to (phenol) | (furaneol + (2,3-diethyl-5-methylpyrazine)*100)) to (nicotine) | (β-ionone + β-damascenone) to (4-(methylnitrosamino)-1-(3-pyridyl)-1-butanone + (R,S)-N-nitrosoanatabine + (R,S)-N-nitrosoanabasine + N-nitrosonornicotine + ((2-furanemethanol)/600)) |
|---|---|---|---|
| 2A | 2.27 | $1.35 \times 10^{-3}$ | 5.25 |
| 2B | 2.96 | $1.71 \times 10^{-3}$ | 3.50 |
| 2C | 4.12 | $2.75 \times 10^{-3}$ | 7.83 |

In all three liquid extracts in accordance with the invention 2A, 2B, and 2C the ratio by weight of (β-ionone+β-damascenone) to (phenol) is consistently and significantly above 2.0. Further, in all three liquid extracts in accordance with the invention 2A, 2B, and 2C the ratio by weight of (furaneol+(2,3-diethyl-5-methylpyrazine)*100)) to (nicotine) is consistently and significantly above $1\times10^{-3}$. Additionally, in all three liquid extracts in accordance with the invention 2A, 2B, and 2C the ratio by weight of (β-ionone+β-damascenone) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600)) is consistently and significantly above 3.

The invention claimed is:

1. A method of manufacturing a concentrated tobacco extract for an aerosol-generating article, the method comprising:

preparing a natural tobacco material, wherein in the step of preparing the natural tobacco material, the natural tobacco material is not subjected to any treatment adapted to alter the pH of the tobacco;

providing the natural tobacco material;

heating the natural tobacco material to a temperature and for a time such that volatile species are released from the natural tobacco material, the volatile species comprising nicotine, wherein the heating the natural tobacco material comprises heating the natural tobacco material in a flow of inert gas or in a flow of a combination of an inert gas with water or steam or heating the natural tobacco material under vacuum;

collecting the released volatile species and forming a liquid, naturally derived tobacco extract comprising the collected volatile species, a polyhydric alcohol, and at least about 40 percent by weight of water; and heating the liquid, naturally derived tobacco extract to evaporate at least some of the water and obtain concentrated tobacco extract, wherein the naturally derived tobacco extract is heated to a temperature and for a time such that a water content in the naturally derived tobacco extract is reduced by at least about 60 percent.

2. The method according to claim 1, wherein in the step of heating the naturally derived tobacco extract, the naturally derived tobacco extract is heated to a temperature and for a time such that the water content in the naturally derived tobacco extract is reduced by at least about 70 percent.

3. The method according to claim 1, wherein in the step of heating the naturally derived tobacco extract, the naturally derived tobacco extract is heated to a temperature and for a time such that the water content in the naturally derived tobacco extract is reduced by less than or equal to about 95 percent.

4. The method according to claim 1, wherein the liquid, naturally derived tobacco extract formed in the step of collecting the released volatile species further comprises at least about 30 percent by weight of the polyhydric alcohol.

5. The method according to claim 1, wherein the liquid, naturally derived tobacco extract formed in the step of collecting the released volatile species further comprises less than or equal to about 60 percent by weight of the polyhydric alcohol.

6. The method according to claim 1, wherein in the step of heating the naturally derived tobacco extract, the naturally derived tobacco extract is heated at a pressure of less than or equal to about 200 mbar.

7. The method according to claim 1, wherein in the step of heating the naturally derived tobacco extract, the naturally derived tobacco extract is heated at a pressure of at least about 20 mbar.

8. The method according to claim 1, wherein in the step of heating the naturally derived tobacco extract, the naturally derived tobacco extract is heated under a flow of air of at least about 10 kg/h.

9. The method according to claim 8, wherein in the step of heating the naturally derived tobacco extract, the naturally derived tobacco extract is heated under a flow of air of at least about 15 kg/h.

10. The method according to claim 8, wherein a relative humidity of the flow of air is less than or equal to about 50 percent.

11. The method according to claim 8, wherein a relative humidity of the flow of air is less than or equal to about 25 percent.

12. The method according to claim 1, wherein in the step of heating the naturally derived tobacco extract, the naturally derived tobacco extract is heated to at least about 35 degrees Celsius.

13. The method according to claim 1, wherein in the step of heating the naturally derived tobacco extract, the naturally derived tobacco extract is heated to at least about 50 degrees Celsius.

14. The method according to claim 1, wherein in the step of heating the naturally derived tobacco extract, the naturally derived tobacco extract is heated to at least about 70 degrees Celsius.

15. The method according to claim 1, wherein the concentrated tobacco extract comprises less than or equal to about 20 percent by weight of water.

16. The method according to claim 1, wherein the concentrated tobacco extract comprises at least about 75 percent by weight of the polyhydric alcohol.

17. The method according to claim 1, wherein the natural tobacco material comprises one or more of Burley tobacco, Oriental tobacco, flue-cured tobacco.

18. The method according to claim 1, wherein the naturally derived tobacco extract comprises at least about 0.1 percent by weight nicotine.

19. The method according to claim 1, wherein the concentrated tobacco extract comprises less than about 70 micrograms/gram acetaldehyde.

20. The method according to claim 1, wherein the concentrated tobacco extract comprises less than about 14 micrograms/gram formaldehyde.

* * * * *